United States Patent [19]

Morfeldt

[11] 4,171,921

[45] Oct. 23, 1979

[54] METHOD FOR PREVENTING THE CONTAMINATION OF SUBSOIL WATER FROM PRODUCTS DEPOSITED ON THE GROUND OR IN UNDERGROUND CAVITIES

[76] Inventor: Carl-Olof Morfeldt, Friggavägen 17, S-181 32 Lidingö, Sweden

[21] Appl. No.: 804,159

[22] Filed: Jun. 6, 1977

[30] Foreign Application Priority Data

Jun. 9, 1976 [SE] Sweden ..... 7606486

[51] Int. Cl.[2] ..... G21F 9/20; E02B 11/00

[52] U.S. Cl. ..... 405/128; 405/36

[58] Field of Search ..... 61/0.5, 1 R, 11, 35; 405/36, 128, 129; 210/70

[56] References Cited

U.S. PATENT DOCUMENTS

| | | | |
|---|---|---|---|
| 994,600 | 6/1911 | Osborne | 61/11 |
| 1,405,725 | 2/1922 | Snively | 61/11 |
| 1,432,489 | 10/1922 | Osterberg | 405/36 |
| 3,586,624 | 6/1971 | Larson | 61/11 X |
| 3,705,851 | 12/1972 | Brauer | 405/129 |
| 3,859,799 | 1/1975 | Jaco | 61/35 |
| 3,925,992 | 12/1975 | Bäckström | 61/0.5 |

*Primary Examiner*—David H. Corbin

*Attorney, Agent, or Firm*—Stevens, Davis, Miller & Mosher

[57] ABSTRACT

A method for preventing the contamination of subsoil water by harmful substances which originate from an object at or near ground level. A tunnel having a water permeable wall is formed below the natural water level to thus form a sink funnel in the subsoil. The accumulated water in the tunnel is drained away quickly enough so that the velocity of water movement toward the tunnel exceeds the water velocity in all other directions.

6 Claims, 3 Drawing Figures

Figure 1:
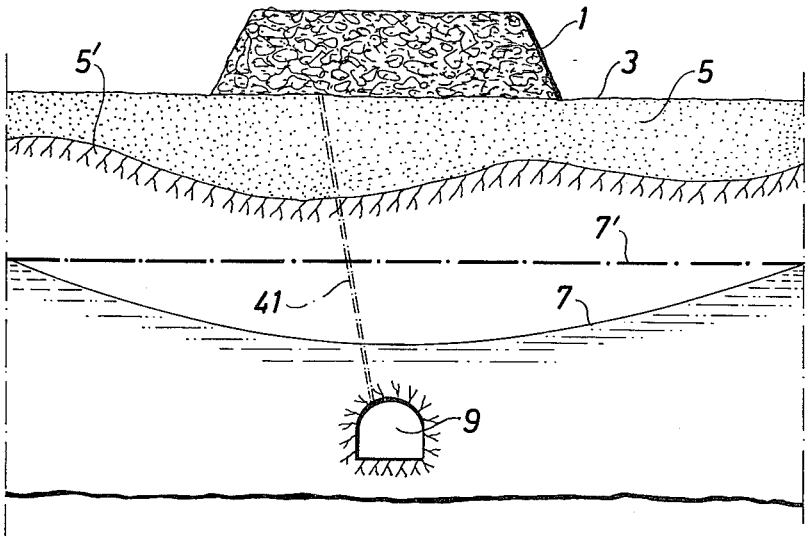

METHOD FOR PREVENTING THE CONTAMINATION OF SUBSOIL WATER FROM PRODUCTS DEPOSITED ON THE GROUND OR IN UNDERGROUND CAVITIES

It has turned out that various products deposited on the ground or in underground cavities are becoming leached by precipitation and/or inflowing surface and subsoil water to such an extent that the water flowing from the products has a harmful effect when the underlying or surrounding subsoil water is reached by and mixed with the leach water. These products can consist of waste from industrial and/or other commercial activities or from homes. Such harmful effect, contamination, in subsoil water often occurs under municipal waste deposits, but also in numerous other waste deposits or storing areas where waste products, poisons, etc. come into contact with ground the leaching of water soluble components and the penetration thereof through the soil to and the mixing thereof with the subsoil water can lead to serious harmful effects on the environment and in the utilization of such water by human beings, animals and plants. A special case is the contamination of water by waste products from nuclear plants stored on the ground or in rock cavities as well as from operating or closed nuclear plants which can be supposed to contaminate the water flow in underlying or surrounding earth and rock minerals.

According to the present invention it has now been found to be possible to control the movement of the contaminated water in earth and rock for the purpose of collecting this water in some type of recipient from which it is transported to a suitable plant for treatment or another place of disposition. Furthermore, a possibility is obtained to check the flow of water in the bedrock with respect to its degree of purity. This is of essential importance, especially when the source of the contamination are stored products from a nuclear plant or the nuclear plant itself.

A method according to the invention for preventing the contamination of subsoil water by harmful substances originating from products disposed at a predetermined place or locality is characterized in that in the area of said place one or more cavities are established in the ground at a level below the natural subsoil water level so that a sink funnel is formed, that the liquid coming into said cavities are drained away from said cavities for further treatment, the draining of said liquid being carried out in such a manner and to such an extent that in the region above the cavity the velocity of movement of the water in the ground in the direction towards said cavity exceeds the velocity of movement of said water in all other directions.

The expression "ground" is intended in the present connection to comprise the bedrock as well as soil or earth covering the bedrock.

The technique according to the invention resides in that the water draining from the deposit, etc. down through the ground is directed to a collecting recipient in that the underlying subsoil water is brought to move in a resultant direction towards this recipient. This is effected by establishing a tunnel or a room under the subsoil water level, the water thus being brought to flow into the tunnel. This means that the subsoil water under the deposit sinks somewhat and a sink funnel, more or less marked, is created. The subsoil water under this funnel is under pressure from the surrounding subsoil water and such portions of the subsoil water which has become mixed with the contaminated water cannot move away from the recipient-tunnel. The recipient can also consist of one or more bores or holes bored from the ground or from a place under the ground. The bored holes are pumped to such an extent that the desired water flow is obtained.

An important factor to be considered when dimensioning a water movement construction according to the invention is that the water shall move with a velocity exceeding the velocity of diffusion in rock for the dissolved substances in water.

Fortunately, this is surprisingly low for most substances, of the magnitude of some meters per year. If the water solution in the bedrock is brought to move with a velocity exceeding the velocity of diffusion, the diffusion cannot lead to contamination of water in any other direction than in the direction of movement of the water.

When storing on or above soil having stagnating residual water such as clays and some morains it may occur that the velocity of diffusion of the contamination exceeds the obtainable velocity of water movement. It will then be necessary to locate the tunnel or tunnels at the side of and obliquely under the storing place and under such soil portions where there is a water movement. The important thing is to prevent that the contamination spreads from semi-impermeable soil minerals to such soil or rock minerals where a normal water movement of not unimportant velocity exists, for instance such soils as sand and gravel where water springs exist.

Figure 2:
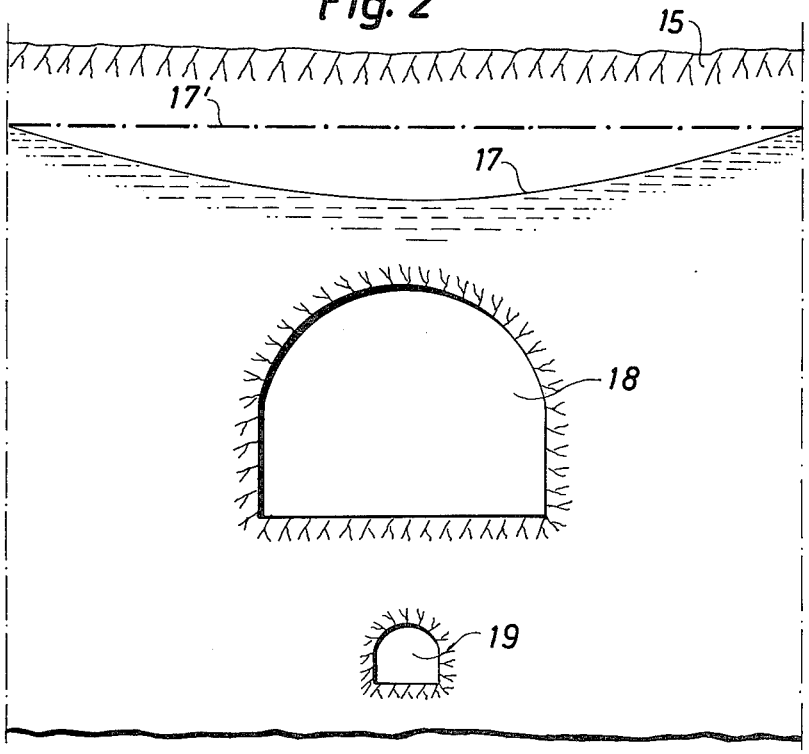
Figure 3:
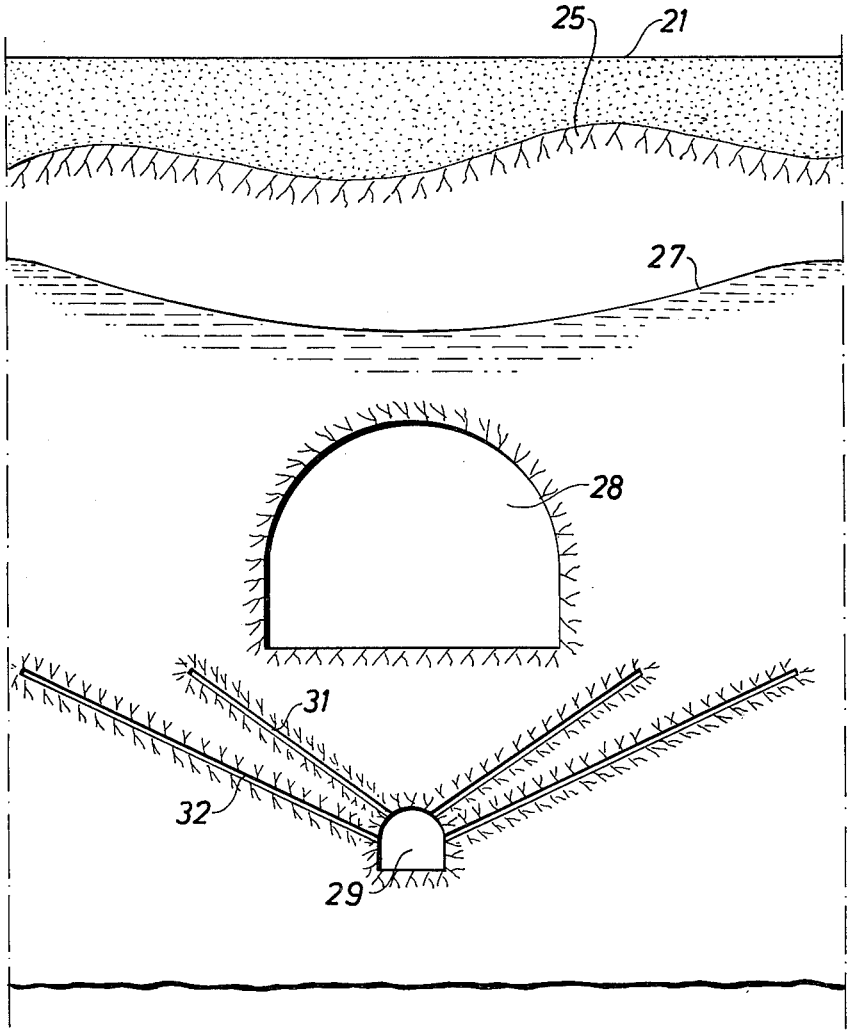

The invention will be described more closely hereinbelow in connection with the enclosed drawings which in FIGS. 1, 2 and 3 show sections through ground areas within which there are deposits etc. liable to emit harmful substances, and cavities and channels built or established according to the invention.

FIG. 1 shows a deposit 1 on the ground surface 3 of a product, for instance waste, which can emit harmful substances to the underlying ground. The ground comprises soil 5 and underlying bedrock 5'. According to the invention a cavity, preferably a tunnel 9, has been established at a level beneath a level 7' representing the subsoil water level in the close surrounding of the deposit 1 which would have existed if a cavity 9 according to the invention had not been established. The tunnel 9 has water permeable walls and the water penetrating through these walls is drained away to a collecting site which is not shown, where it can be taken care of and made harmless in a manner known per se.

Since the water in the ground is brought to move continuously with a net or resultant direction towards the tunnel 9 the subsoil water level will be lowered and will assume funnel or valley shape above the tunnel as indicated at 7 in FIG. 1. This general and continuous lowering of the subsoil water level is a precondition for the correct direction of the water movement in the ground. The extent of the required lowering of the subsoil water is, however, depending on several factors such as the degree of contamination to be taken care of, the degree of water flow in soil and rock layers to be taken care of, etc.

In contradistinction to the orientation in the plane of tunnels for other draining purposes the tunnel in the present case should be established approximately in parallel with existing, dominating fissures which leads to maximum leaching into the tunnel. If these fissures are varying locally in size to a great extent the larger leaching passages can be reduced by injecting concrete or the like into the earth/rock at such places. Portions along the tunnel showing low leakage thereinto can be provided with bores from the tunnel for locally increasing the leakage and for improving the water movement in the surrounding ground. These bores which can be horizontal, oblique or vertical are intended to cross existing zones of fissure and/or other water conducting layers or zones, so that contamination via stillstanding pore water does not diffuse over to freely situated zones, if any, having movable water which is not affected by the sink funnel created by the tunnel only. In this manner a limitation is obtained of the propagation of pore water which has been contaminated by diffusion. For the bedrock is almost always crossed by fissures and discontinuities to such an extent that the contaminated pore water is contained in a very limited area if the movable water is directed towards the recipient carrying away water which has been contaminated by diffusion into pore water. In order to further increase the flow of water to the cavity or the recipient which in the present case is represented by a tunnel 9, holes can be bored therefrom obliquely upwards and in the upper portion of the holes water can be injected into the holes at a suitable pressure. The magnitude of the flow into the tunnel which can be easily measured can be translated to a flow velocity in the rock and can be controlled by means of the bores so that contamination by diffusion does not occur outside the earth/rock volume which is controlled as to the flow into the tunnel. Furthermore, the water flowing into the tunnel can be checked with respect to the presence of in the subsoil water of substances carried by said water. This is important mainly in the case of waste products from nuclear power plants and products from operating or closed nuclear power plants which can contaminate subsoil water.

In some cases where the deposited product 1 is to be downgraded by microorganisms, requiring separate supply of oxygen or air, bores or pipes 41 can be provided in the ground extending from the cavities 9 to or into the product 1. Oxygen or air can then be supplied under pressure to the bores or pipes 41 from the cavities 9 thus increasing the speed with which the degradation of the product 1 by said microorganisms takes place.

In FIG. 2 there is shown a rock cavity 18 in the bedrock 15, said cavity being intended for a plant of some type including a nuclear power plant or for waste products, and a tunnel 19 is established according to the invention under the space 18. By establishing the cavities 18 and 19 the subsoil water level is lowered from the level indicated by 17' to the funnel or valley-formed level indicated by 17. The tunnel 19 ensures that harmful substances from the rock cavity 18 never can contaminate subsoil water flowing in other directions than towards the tunnel 19, because all subsoil water in the close surrounding of the space 18 will always move in a resultant direction towards the tunnel 19 from which it is removed and further processed in a manner known per se.

In FIG. 3 a site in the bedrock for storing waste from a nuclear plant is shown in vertical section. Here the ground surface is indicated at 21. The bedrock is indicated at 25. At 27 the subsoil water level is indicated as having a sink funnel caused by the tunnel 29. One or more bored holes 31 are arranged to drain water, including contaminated water from the radioactive waste into the tunnel. Moreover, one or more other bored holes 32 have been established in which water free from harmful contamination is pressed for obtaining a flow directed horizontally. Such bored holes or tubes as those indicated at 32 can extend, alternatively, from the atmosphere above ground and serve to ensure that all contaminated water is directed to the tunnel 29.

If the deposit site 28 is established in soil or other material which is not wholly consolidated the bored holes 31 and/or 32 can be replaced by draining tubes the walls of which being perforated or porous so that water can pass into said tubes or out from the tubes, respectively.

28 designates a bedrock cavity which is well clad-in with concrete, if desired also with plate or sheet, in which waste from nuclear plants can be kept molded into a suitable material highly resistant to any degradation caused by the radioactive waste. By this arrangement the rock cavity will be surrounded by almost water-free rock. A similar arrangement can be used when the nuclear waste store is to be established in a heavy layer of clay or other suitable soil.

Bored holes as those indicated at 31 and 32 and described above can be provided also in the embodiment shown in FIG. 1 with or without combination with holes or tubes, such as those indicated in FIG. 1 by 41, for supplying oxygen or air to the storage deposit.

The water flowing into the tunnel can pass devices arranged to automatically make alarm if the measured values of one or more predetermined parameters are near or exceed allowable values.

Similar checking devices under a nuclear power plant also seem to be required so that knowledge is obtained whether there is or is not a dissipation of radioactive water.

It should be pointed out in addition that when establishing plants in rock under the ground, not least plants where nuclear energy is produced or products from nuclear plants are stored, such rock regions should be localized where the rock is practically water-tight.

I claim:

1. A method for preventing the contamination of subsoil water by harmful substances originating from an object disposed at a predetermined locality, the ground beneath said locality having a rocky layer, said method comprising:

forming at least one tunnel having a water permeable wall in the rocky layer at a level below said locality and below the natural subsoil water level to thus form a sink funnel;

draining away the liquid coming into said tunnel for further treatment and carrying out the draining of said liquid in such a manner and to such an extent that in the region above the tunnel the velocity of movement of the water in the rocky layer in the direction towards the tunnel exceeds the velocity of movement of said water in all other directions.

2. A method as claimed in claim 1, in which said tunnel is formed under the subsoil water level existing prior to the forming of said tunnel in a manner such that all subsoil water in the close surrounding of said locality is directed to said tunnel for further treatment.

3. A method as claimed in claim 1, in which the number, size and location of the tunnel in the rock and the draining therefrom is chosen and carried out, such that in the region above the tunnel the velocity of movement of the ground water in a direction towards the tunnel exceeds the velocity of diffusion in stillstanding water of substances which are water soluble so that the spreading thereof into the surrounding subsoil water is prevented.

4. A method as claimed in claim 1, including boring at least one hole from said locality to said tunnel.

5. A method as claimed in claim 1, including boring at least one hole from said tunnel to the atmosphere.

6. A method as claimed in claim 1, in which the deposited material from which contamination can be expected consists of radioactive products.

* * * * *